US006997457B2

(12) United States Patent
Arana et al.

(10) Patent No.: US 6,997,457 B2
(45) Date of Patent: Feb. 14, 2006

(54) METHOD OF PLAYING A GAME

(75) Inventors: John Thomas Arana, Encinitas, CA (US); Michael Arthur Kaiser-Mistriel, Del Mar, CA (US)

(73) Assignee: M. Arthur Kaiser-Mistriel, Del Mar, CA (US)

( * ) Notice: Subject to any disclaimer, the term of this patent is extended or adjusted under 35 U.S.C. 154(b) by 0 days.

(21) Appl. No.: 10/620,152

(22) Filed: Jul. 15, 2003

(65) Prior Publication Data

US 2005/0023757 A1 Feb. 3, 2005

(51) Int. Cl.
*A63F 3/00* (2006.01)

(52) U.S. Cl. ..... 273/260; 273/242

(58) Field of Classification Search ..... 273/258, 273/260, 242, 261

See application file for complete search history.

(56) References Cited

U.S. PATENT DOCUMENTS 2,811,360 A * 10/1957 Cohen ..... 273/272

* cited by examiner

*Primary Examiner*—Vishu K. Mendiratta

(57) ABSTRACT

This is a novel two-player board game which uses addition and subtraction to initiate the movement of a player's pieces. The game is comprised of two sections; each section consists of a plurality of spaces containing integers. The interior section is comprised of opposite sides separated by zeros, one side containing negative integers and the other positive. Pieces are provided to each player for separate use in the exterior and interior sections. Movement is initiated by positioning pieces in the exterior section on spaces whose integers produce a difference of two integers found in the interior section, thus enabling pieces to move from one space to another. The object of this game is to be the first player with all his/her pieces positioned within the interior section on spaces whose integers when added together equal zero.

2 Claims, 6 Drawing Sheets

1 2 3

| 0 | -/+ 1 | -/+ 1 | -/+ 2 | -/+ 3 | -/+ 5 | -/+ 8 | -/+ 13 | -/+ 21 |
|---|---|---|---|---|---|---|---|---|
| +/- 1 | 0 | -7 | -11 | -16 | -21 | -29 | -40 | -/+ 13 |
| +/- 1 | 7 | 0 | -6 | -9 | -14 | -20 | -29 | -/+ 8 |
| +/- 2 | 11 | 6 | 0 | -5 | -8 | -14 | -21 | -/+ 5 |
| +/- 3 | 16 | 9 | 5 | 0 | -5 | -9 | -16 | -/+ 3 |
| +/- 5 | 21 | 14 | 8 | 5 | 0 | -6 | -11 | -/+ 2 |
| +/- 8 | 29 | 20 | 14 | 9 | 6 | 0 | -7 | -/+ 1 |
| +/- 13 | 40 | 29 | 21 | 16 | 11 | 7 | 0 | -/+ 1 |
| +/- 21 | +/- 13 | +/- 8 | +/- 5 | +/- 3 | +/- 2 | +/- 1 | +/- 1 | 0 |

Fig. 1

| 0 | -/+ 1 | -/+ 1 | -/+ 2 | -/+ 3 | -/+ 5 | -/+ 8 | -/+ 13 | -/+ 21 |
|---|---|---|---|---|---|---|---|---|
| +/- 1 | 0 | -7 | -11 | -16 | -21 | -29 | -40 | -/+ 13 |
| +/- 1 | 7 | 0 | -6 | -9 | -14 | -20 | -29 | -/+ 8 |
| +/- 2 | 11 | 6 | 0 | -5 | -8 | -14 | -21 | -/+ 5 |
| +/- 3 | 16 | 9 | 5 | 0 | -5 | -9 | -16 | -/+ 3 |
| +/- 5 | 21 | 14 | 8 | 5 | 0 | -6 | -11 | -/+ 2 |
| +/- 8 | 29 | 20 | 14 | 9 | 6 | 0 | -7 | -/+ 1 |
| +/- 13 | 40 | 29 | 21 | 16 | 11 | 7 | 0 | -/+ 1 |
| +/- 21 | +/- 13 | +/- 8 | +/- 5 | +/- 3 | +/- 2 | +/- 1 | +/- 1 | 0 |

METHOD OF PLAYING A GAME

CROSS-REFERENCE TO RELATED APPLICATIONS

Not Applicable

STATEMENT REGARDING FEDERALLY SPONSORED RESEARCH

Not applicable

REFERENCE TO SEQUENCE LISTING, A TABLE, OR A COMPUTER PROGRAM

Not Applicable

BACKGROUND OF THE INVENTION

This invention relates to the class of board games, specifically those having pieces that move over a board having a pattern, in which two players are trying to obtain a winning position.

BRIEF SUMMARY OF INVENTION

It is the object of this invention to provide a novel board game that is both entertaining and educational. This game is to be played by two players and is played on the basis of specific rules with two distinguishable sets of playing pieces. The game board is made up of a plurality of spaces containing integers and two visually distinguishable sections, section X and section Y. Specific pieces in each player's set are moved only in section X and specific pieces in each player's set are moved only in section Y. One player's starting position is on the negative side and one on the positive side. The pieces moved in section X are positioned on integers to create the difference between two or more integers in section Y, making it possible to move a piece or pieces from one space to another in section Y. One side of section Y consists of negative integers and the other side consists of positive integers; in between the two sides lies a row of zeros. The object of the game is to be the first player to position all of his/her pieces played in section Y on integers that when added together equal zero.

BRIEF DESCRIPTION OF DRAWINGS

FIG. 1 illustrates the game board, showing the differentiation between section X 2 and section Y 3.

DETAILED DESCRIPTION OF THE INVENTION

As illustrated in FIG. 1 the game board 1 has two visually distinguishable sections, X 2 and Y 3. Section X 2 consists of 32 defined square spaces and section Y 3 consists of 49 defined square spaces.

Figure 2:
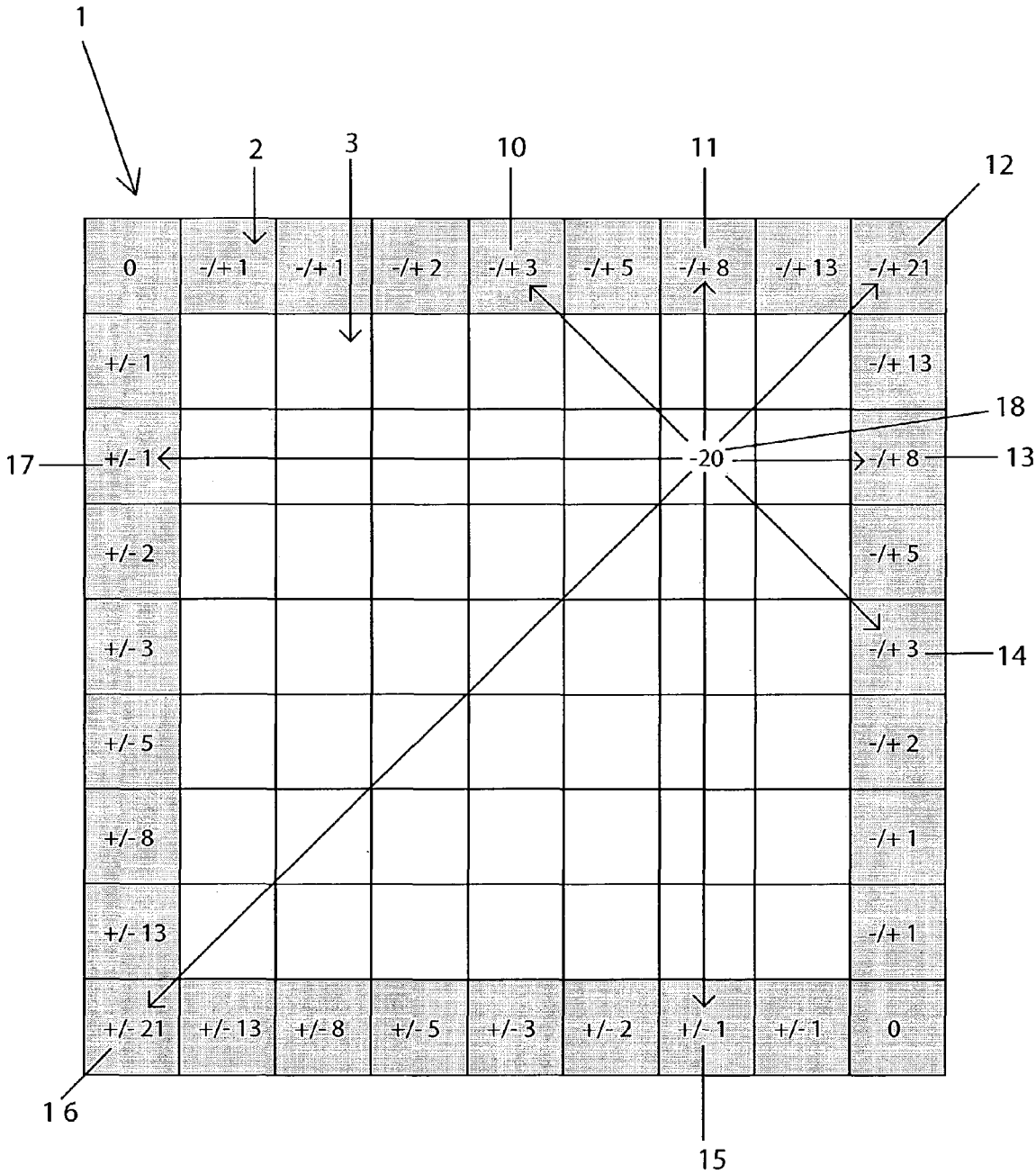
FIG. 2 is an example of how an integer, located within a space of section Y 3, is found.

FIG. 2 illustrates the process of finding the integers located in the spaces of section Y 3. The space containing the integer −20 18 of section Y 3 is used as an example. The integer −20 18 is found by adding the eight integers contained in the spaces of section X 2 located perpendicular and at forty-five degree angles to the space containing the integer −20 18. Those eight integers in section X 2, located perpendicular and at forty-five degree angles to the space containing the integer −20 18 that are preceded by a +/− symbol, are added as positive integers and those integers preceded by a −/+ are added as negative integers. Therefore, the integer −20 18 in section Y 3 is derived by the process of adding the integers: 1 15, 21 16, 1 17, −3 10, −8 11, −21 12, −8 13, −3 14 of section X 2 this expression (1+21+1+−3+−8+−21+−8+−3) is equal to −20. This process is done to each of the 49 square spaces of section Y 3 determining all of the integers contained therein.

Figure 3:
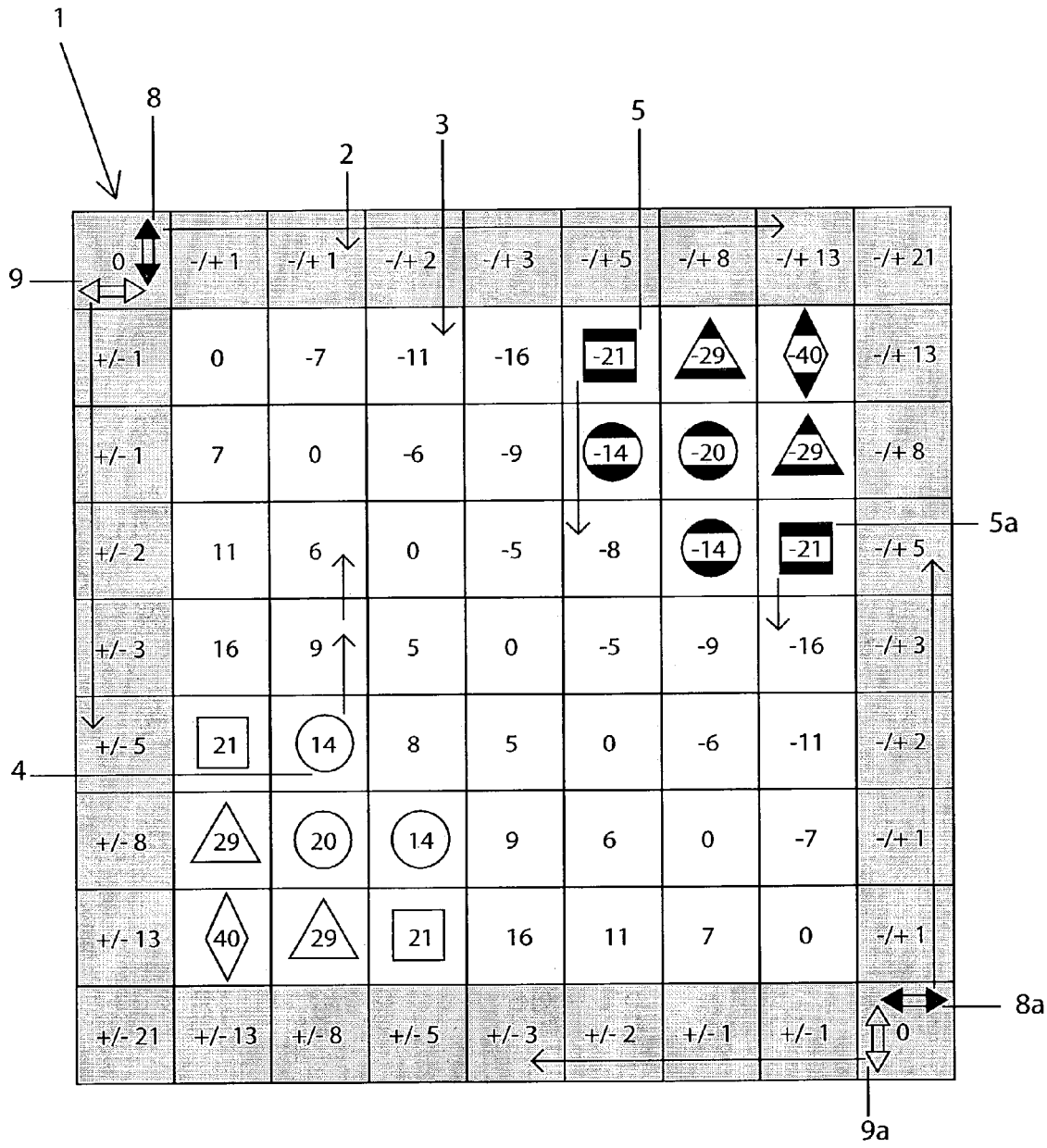
FIG. 3 is an example of how a piece or pieces in section Y 3 are moved using a piece or pieces in section X 2.

FIG. 3 illustrates the process of movement in this game. A playing piece in section Y 3 can only be moved to a new space when the difference between the integer contained in that space and the integer contained in the piece's current space is created. This is done by placing the pieces located in section X 2 on an integer or integers that create the difference between the two spaces in section Y 3. In this example the arrow piece 8 is moved in section X 2 onto the space containing the integer −/+13, making it possible for square piece 5 to move from the space containing the integer −21 to the space containing the integer −8 in section Y 3. Arrow piece 8*a* is moved in section X 2 onto the space containing the integer −/+5, making it possible for square piece 5*a* to move from the space containing the integer −21 to the space containing the integer −16 located in section Y 3. Arrow piece 9 is moved in section X 2 onto the space containing the integer +/−5, making it possible for circle piece 4 to move from the space containing the integer 14 to the space containing the integer 9 in section Y 3. Arrow piece 9*a* is moved in section X 2 onto the space containing the integer +/−3, making it possible for circle piece 4 to move from the space containing the integer 9 to the space containing the integer 6 in section Y 3.

Figure 4:
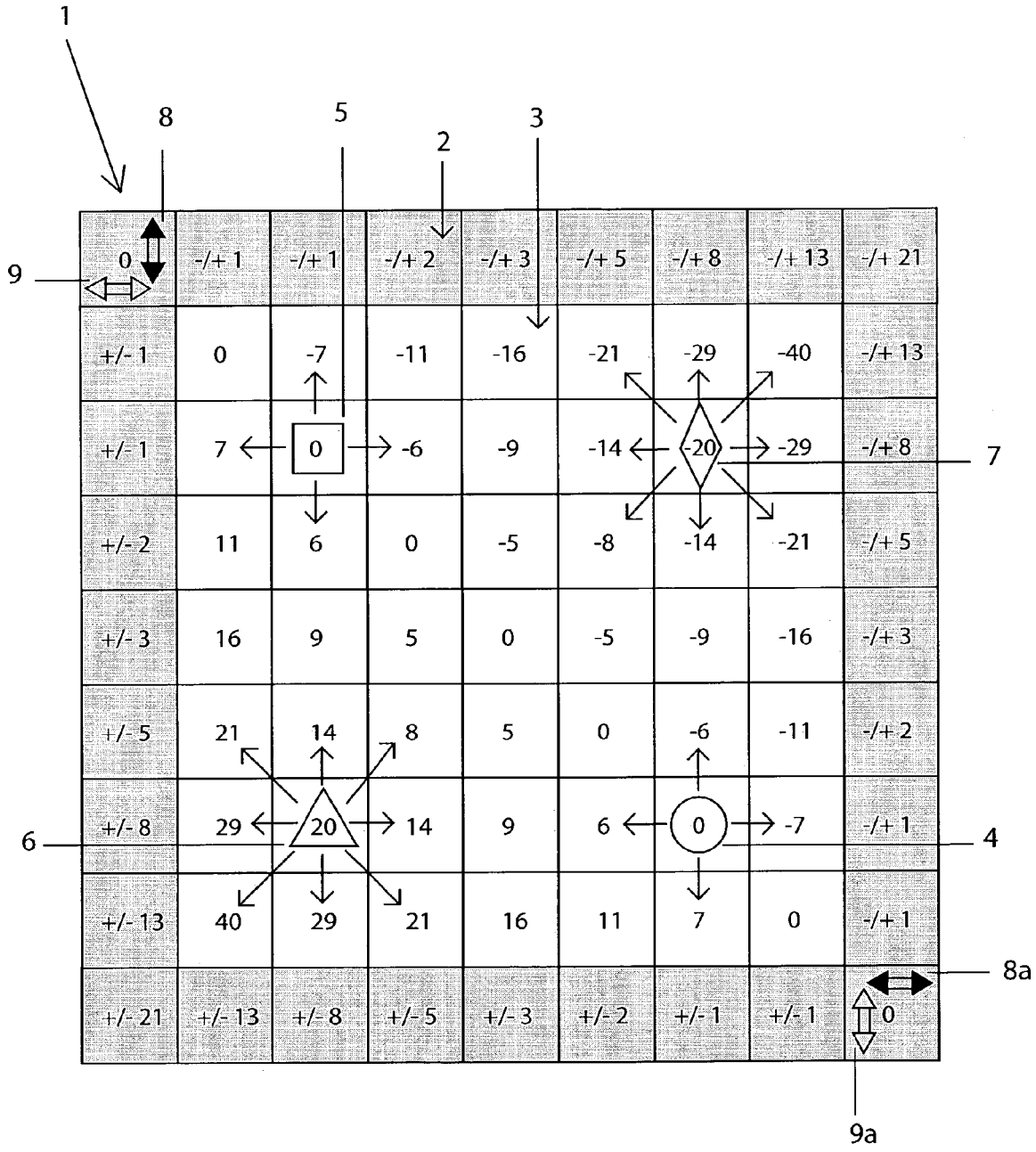
FIG. 4 shows the ability of movement specific to each type of piece.

FIG. 4 illustrates the movement ability of each type of piece. The circle piece 4 can move horizontally and vertically anywhere within section Y 3 providing no other piece is blocking its path. The square piece 5 can move horizontally and vertically anywhere within section Y 3 and can jump over a piece or pieces blocking its path in those directions. The triangle piece 6 can move horizontally, vertically, and diagonally anywhere within section Y 3 providing that there is no other piece blocking its path. Diamond piece 7 is able to move horizontally, vertically, and, diagonally within section Y 3 and can jump over a piece or pieces blocking its path in those directions. Arrow pieces 8 and 8*a* can be placed on any space within section X 2 containing the symbol −/+ or a zero. Arrow pieces 9 and 9*a* can be placed on any space within section X 2 containing the +/− symbol or a zero.

Figure 5:
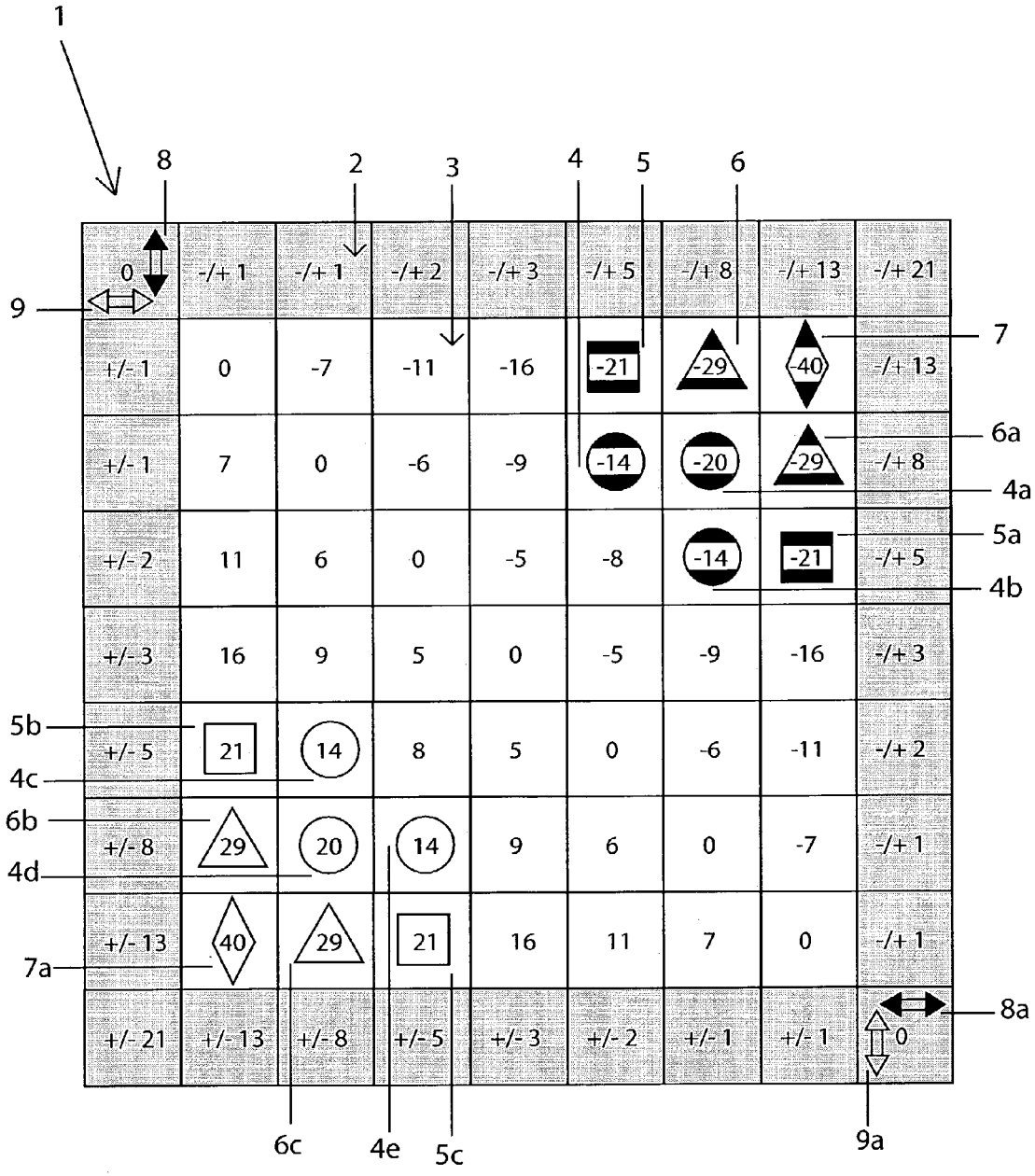
FIG. 5 shows the preferred starting positions of each player's set of pieces in section X 2 and Y 3.

FIG. 5 shows the preferred starting positions of each piece of each player's set of playing pieces. Player one's set of pieces is illustrated as white and player two's pieces are illustrated as black. The diamond piece 7 is placed in section Y 3 on the spaces containing the integers 40 for player one; the diamond piece 7*a* is placed in section Y 3 on the space containing the integers −40 for player two. The triangle pieces 6 and 6*a* are placed in section Y 3 on the spaces containing the integers 29 and 29 for player one; the triangle pieces 6*b* and 6*c* are placed in section Y 3 on the spaces containing the integers −29 and −29 for player two. The square pieces 5 and 5*a* are placed in section Y 3 on the spaces containing the integers 21 and 21 for player one; the square pieces 5*b* and 5*c* are placed in section Y 3 on the spaces containing the integers −21 and −21 for player two. The circle pieces 4, 4*a*, 4*b*, are placed in section Y 3 on the spaces containing the integers 14,14, and 20 for player one; The circle pieces 4*c*, 4*d*, 4*e*, are placed in section Y 3 on the spaces containing the integers −14,−14, and −20 for player two. The arrow pieces 8 and 9 are placed in section X 2 on one of the spaces containing the integer zero, for both player one and player two; The arrow pieces 8*a* and 9*a* are placed in section X 2 on the other space that contains the integer zero, for both player one and two.

Figure 6:
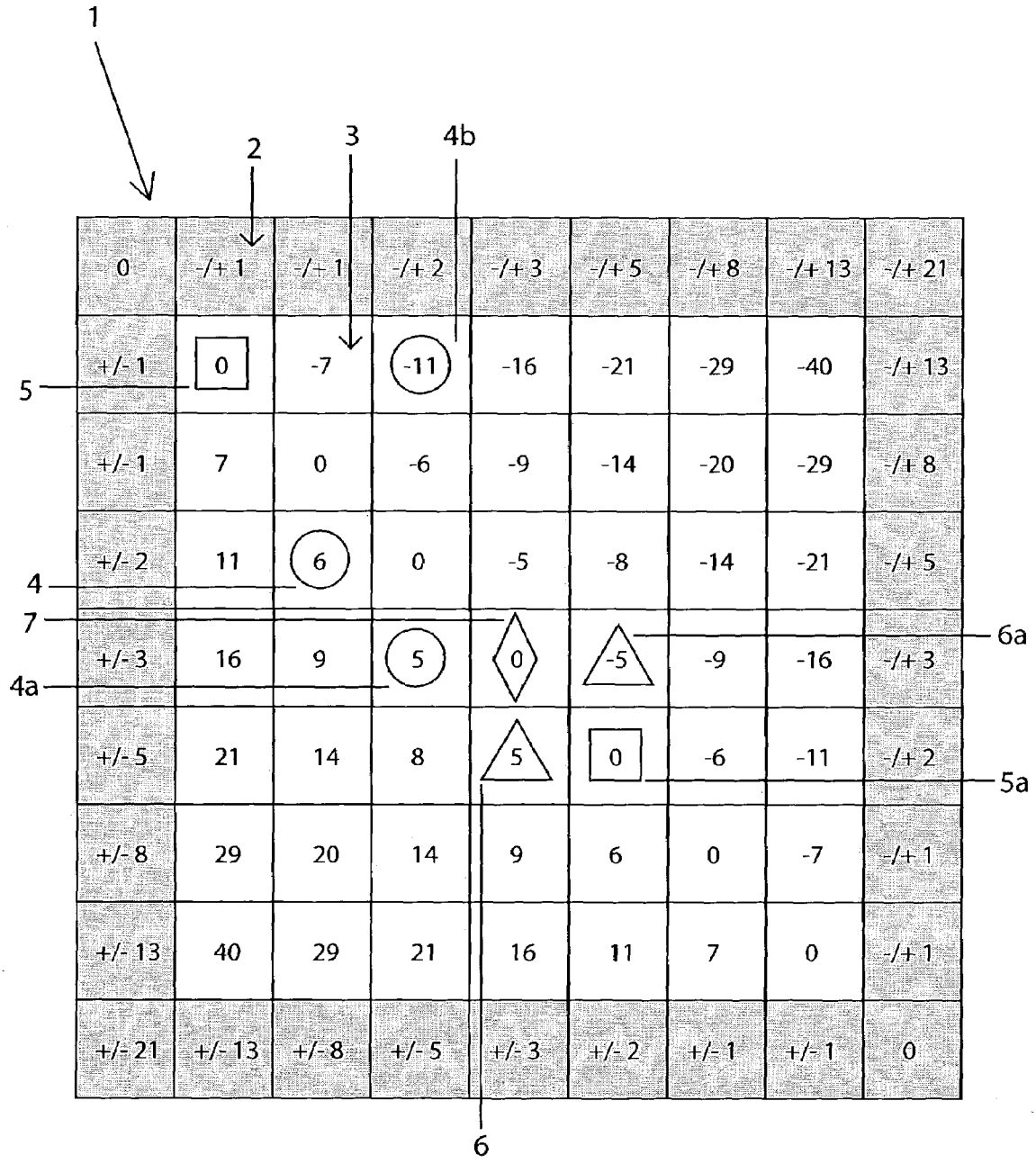
FIG. 6 is an example of a winning situation for one player's set of pieces.

FIG. 6 illustrates the object of the game which is to place one's alike pieces located in section Y 3 on spaces containing integers that when added together equal zero. In this example of a winning situation, circle piece 4 is on a space containing the integer 6, circle piece 4*a* is on a space containing the integer 5 and circle piece 4*b* is on a space containing the integer −11. Square piece 5 is on a space containing the integer 0 and square piece 5*a* is on a space containing the integer 0. Triangle piece 6 is on a space containing the integer 5 and triangle piece 6*a* is on a space containing the integer −5. Diamond piece 7 is on a space containing the integer 0. Each of the alike pieces are on spaces containing integers that when added together equal zero, which is the preferred winning condition of the game.

PREFERRED EMBODIMENT

The game board 1 is made of a material such as: wood, plastic, marble, cardboard or any other suitable material. If possible it is preferred that the game board 1 can be folded in half, from its square shape into a triangle, wherein the crease is along the spaces containing the integer zero. Alternatively, it may be made to fold into a triangle with the crease along the opposite diagonal or in half into a rectangle. The game board 1 may also be a divisible board, which could be taken apart and put together.

It is preferred that each of the two players are assigned a set of 10 pieces. 3 of which are distinguished as circles, 2 of which are distinguished as squares, 2 of which are distinguished as triangles, 1 piece distinguished as a diamond, and 2 pieces distinguished as arrows. The two sets of playing pieces must be visually distinguishable. It is preferred that the playing sets are distinguished by color. The preferred color scheme is to have one player assigned pieces that are distinguished as being black and the other player having pieces that are distinguished as being white. It is possible that the displays applied to the faces of the pieces are differentiated from each other into shapes other than circles, squares triangles, diamonds, and arrows. Alternatively, characters such as numerals, alphabets, colors, marks or symbols, patterns or designs, which are different from each other, may be applied to the faces of the pieces.

It is preferred that the aforementioned playing pieces are cubes made out made out of a transparent glass or acrylic material, allowing the players to view the integers located on the board through each piece. Alternatively, the pieces may be made out of a material such as paper, cardboard, wood, metal or a synthetic resinous material such as plastic or the like. The pieces are preferably distinguishable by paint, ink, vinyl decal or the like, which is preferably applied to four of the faces of the cubes.

The regulations of the game are as follows:

1) Each player is given a set of pieces that is either white or black. The player that is using the white pieces, positions his pieces in the preferred position, on the positive integers, located in section Y 3 as shown in FIG. 5. The player that is using the black pieces, positions his pieces in the preferred position, on the negative integers, located in section Y 3 as shown in FIG. 5. The playing pieces which start in section X 2, may only be moved within section X 2 and the pieces which start in section Y 3 may only be moved within section Y 3.
2) The player starting on the side containing positive integers and using the white set of pieces makes the first move.
3) A player moves by using his two pieces, signified by arrows, which move within section X 2, to create an integer which is the difference between two integers in section Y 3, enabling a piece in section Y 3 to move. This is done by placing the arrow piece on the space containing the desired integer or using the arrow pieces in combination to create a number. Each arrow piece may be used together or apart once per turn. The arrow pieces may be moved anywhere in section X 2 on that player's side of the board. This process of movement is illustrated in FIG. 3.
4) At the beginning of a player's turn, the player may choose to use the integer or integers, which were used in section X 2, the turn before, again. The player may only use each integer once, in combination or apart, no matter how they were used during the previous turn, to move a piece in section Y 3. The player may choose to discard this opportunity and whether a player uses it or not, he/she gets to make a new move.
5) Each piece's movement ability is illustrated in FIG. 4.
6) A player wins the game when he/she has positioned his/her alike pieces, played within section Y 3, on integers that when added together equal zero. As illustrated in FIG. 6.
7) A player must make a move if it is possible. If it is not possible for a player to make a move, he/she loses his/her turn.
8) An optional rule may also be applied, wherein if a player positions his/her circles, squares, triangles or diamond on an integer or integers that when added together equal zero, the other player loses the opportunity to use the integers he/she placed his arrow pieces on the turn before, in his upcoming turn.
9) An alternative to rule #8 wherein this rule is applied and continued only when the player who went second makes his/her first positioning of alike pieces to equal zero or when the player who went first positions two types of his/her alike pieces on integers that when added together equal zero.
10) An alternative to rule #6 wherein the winning positioning is achieved by placing one's pieces located within section Y 3, whether or not they are alike, on integers that when added together equal zero.
11) An alternative to rule #7 wherein if a player is unable to make a move he/she loses the game rather than his turn.
12) An alternative to rule #2 wherein the player using the black pieces goes first.

It is to be understood that the embodiments herein described are merely illustrative of the application of the principles of the invention. Reference herein to details of the illustrated embodiments are not intended to limit the scope of the claims, which themselves recite those features that are essential to the invention.

What is claimed is:

1. A method of playing a board game, comprising the steps of:

a. using a playing surface, wherein said surface is comprised of sections X and Y; each said section is comprised of a plurality of defined spaces, each said space contains an integer; said defined spaces of said section Y are arranged in a grid of rows and columns, said defined spaces of said section X border said grid of said section Y;

b. each player is assigned a distinguishable set of playing pieces;

c. positioning a plurality of playing pieces from each player's said set of playing pieces on predetermined spaces within said section Y and positioning a plurality of pieces from each player's said set of playing pieces on predetermined spaces within said section X;

d. allowing each player on a turnabout basis to move a playing piece from a current space in Y section to a new space in Y section only if the difference of integers between said new Y space and the current Y space is equal to an integer created by moving a piece or pieces from their current spaces in X section to new spaces in X section;

e. allowing a player to win the game if said player is the first to position each said piece, within section Y, on integers that when added together equal zero.

2. The method of play as recited in claim 1 wherein:

a. said section Y is comprised of a square grid of 7 rows and 7 columns of 49 defined square spaces, each said square space contains an integer; said square spaces comprising section Y contain the integers 0, 0, 0, 0, 0, 0, 0, 40, 29, 29, 21, 21, 20, 16, 16, 14, 14, 11, 11, 8, 9, 9, 7, 7, 6, 6, 5, 5, −40, −29, −29, −21, −21, −20, −16, −16, −14, −14, −11, −11, −8, −9, −9, −7, −7, −6, −6, −5 , −5; said section Y is bordered by said section X; said section X is comprised of 32 defined square spaces, each said square space contains an integer; said square spaces comprising section X contain the integers 0, 0 1, 1, 1, 1, 2, 2, 3, 3, 5, 5, 8, 8, 13, 13, 21, 21; said integers contained in said square spaces of said section X can be used as both positive or negative;

b. each player's distinguishable set of playing pieces is comprised of three pieces distinguished as circles, two pieces distinguished as squares, two pieces distinguished as triangles, one piece distinguished as a diamond, and two pieces distinguished as arrows;

c. the preferred starting position of each player's said set of distinguishable playing pieces is 14, 14, and 20 in said section Y for player one's pieces distinguished as circles, 21 and 21 in said section Y for player one's pieces distinguished as squares, 29 and 29 in said section Y for player one's pieces distinguished as triangles, 40 in said section Y for player one's piece distinguished as a diamond, −14, −14, and −20 in said section Y for player two's pieces distinguished as circles, −21 and −21 in said section Y for player two's pieces distinguished as squares, −29 and −29 in said section Y for player two's pieces distinguished as triangles, −40 in said section Y for player two's piece distinguished as a diamond, both player's pieces distinguished as arrows have their starting positions on the spaces containing the integers 0 and 0 in said section X;

d. each said piece distinguished as a circle and each said piece distinguished as a square may only move horizontally and vertically along the axis of defined square spaces in said section Y, each said piece distinguished as triangle and each said piece distinguished as a diamond may move horizontally, vertically, and diagonally along the axis of defined square spaces in said section Y; said pieces distinguished as squares and diamonds may move over a piece or pieces blocking their path to the next unoccupied space, pieces distinguished as arrows may move freely to any desired space within said section X;

e. allowing a player to win the game if said player is the first to position each said piece distinguished as a circle on integers, in said section Y, that when added together equal zero; to position each said piece distinguished as a square on integers, in said section Y, that when added together equal zero; to position each said piece distinguished as a triangle on integers, in said section Y, that when added together equal zero; and to position said diamond piece on a space containing the integer 0.

* * * * *